United States Patent [19]

Walton

[11] 4,224,128

[45] Sep. 23, 1980

[54] CATHODE ASSEMBLY FOR ELECTROLYTIC ALUMINUM REDUCTION CELL

[75] Inventor: Richard J. Walton, Pittsburgh, Pa.

[73] Assignee: PPG Industries, Inc., Pittsburgh, Pa.

[21] Appl. No.: 67,598

[22] Filed: Aug. 17, 1979

[51] Int. Cl.[2] ..... C25C 3/08

[52] U.S. Cl. ..... 204/243 R

[58] Field of Search ..... 204/64 R, 67, 243 R

[56] References Cited

U.S. PATENT DOCUMENTS

| | | | |
|---|---|---|---|
| 3,028,324 | 4/1962 | Ransley | 204/67 |
| 3,093,570 | 6/1963 | Dewey | 204/243 R |
| 3,156,639 | 11/1964 | Kibby | 204/243 R |
| 4,071,420 | 1/1978 | Foster et al. | 204/67 |

*Primary Examiner*—Howard S. Williams
*Attorney, Agent, or Firm*—Irwin M. Stein

[57] ABSTRACT

Described is a cathode assembly for an electrolytic cell for the production of metal, e.g., aluminum, by electrolysis of molten electrolyte containing a compound of the metal, e.g., alumina. The cathode assembly comprises pedestals, e.g., a carbon pedestal, disposed on the cell floor beneath the shadow of the anode of the cell. The pedestal rises from the cell floor to a height of at least the highest interface of the metal pad and molten electrolyte that exists during cell operation. Embedded in the pedestal is at least one refractory hard metal element, e.g., titanium diboride, which is embedded to a depth of at least about 75 percent of its length. The refractory hard metal element(s) can be flush with the top surface of the pedestal; but, preferably protrude slightly from the top surface of the pedestal. The refractory hard metal element can be a solid or hollow body, e.g., cylinder. The pedestal can have a refractory hard metal surface for its side walls and be shaped to assist in the drainage of molten aluminum.

14 Claims, 5 Drawing Figures

CATHODE ASSEMBLY FOR ELECTROLYTIC ALUMINUM REDUCTION CELL

DESCRIPTION OF THE INVENTION

In the electrolytic production of some metals, an electrolyzing current is passed from the anode to the cathode of an electrolytic cell through an electrolyte comprising a molten compound of the metal dissolved in a molten solvent. One of the more common metals produced by such a process is aluminum.

The electrolytic cell in common use today for the preparation of aluminum is of the classic Hall-Heroult design, i.e., the Hall cell. The cell utilizes carbon anodes and a carbon-lined bottom, which functions as part of the cathodic system. The carbon anodes extend into the cell from above and make contact with the electrolyte. Current collector bars, usually of steel, are embedded in the substantially horizontal carbon bottom and complete the connection to the cathodic system. The electrolyte used typically consists primarily of molten cryolite in which is dissolved alumina and which contains other material such as fluorspar. Molten aluminum resulting from the reduction of alumina accumulates at the bottom of the electrolytic cell as a molten pool over the carbon-lined bottom and serves as a molten metal cathode.

Electromagnetic wave effects and poor circulation cause the molten metal cathode to vary in thickness, which limits how far the inter-electrode spacing i.e., the anode-cathode distance, can be reduced. Should the molten metal cathode touch the anode, a short circuit would occur.

The consumption of power due to resistance to current flow in the inter-electrode space is one of the largest losses experienced in operating a Hall cell. Reducing the inter-electrode spacing will result in significant savings of electric power, thereby improving the power efficiency of the cell.

Refractory hard metal (RHM) articles, e.g., titanium carbide and titanium diboride, have been suggested for use in the Hall cell as cathodic elements. These articles, when properly fabricated, are resistant to chemical attack by the electrolyte and molten aluminum, and their use permits operation of the Hall cell with a more narrow inter-electrode spacing than conventional Hall cells because they are wetted by the molten aluminum. See, for example, U.S. Pat. Nos. 3,028,324, 3,400,061, and 4,071,420. However, refractory hard metal articles, such as those prepared from titanium carbide or titanium diboride, are ceramic in nature and can crack or disintegrate if subjected to severe thermal stress, e.g., thermal shock. See, for example, U.S. Pat. No. 3,028,324, column 24, lines 69–72.

It has been found that titanium diboride shaped articles, e.g., cylinders, which are used as cathodes in an aluminum reduction cell, have experienced cracking. These cracks frequently appear in the portion of the article nearest the anode and where the article is exposed to the electrolyte. It is not known for certain whether the cracks occur as a result of thermal shock from cell start-up (or shut down) or from contact with the anode during cell operation. These cracks may empair the useful life of the articles. Therefore, there appears to be a need for further protection of such elements.

It has now been discovered that refractory hard metal articles used as cathodic elements in an aluminum reduction cell can be protected during the start of cell operation by embedding such articles in an electroconductive pedestal disposed beneath the shadow of the anode. The pedestal, preferably a carbon pedestal, extends from the floor of the cell to a height corresponding to at least the highest interface between the molten metal pad and molten electrolyte that exists during cell operation but below and spaced from the operating face of the anode. The refractory hard metal article is embedded in the pedestal to a depth of at least 75 percent of its length, thereby protecting the article from mechanical and thermal stresses imposed upon the article during cell start-up and cell operation.

BRIEF DESCRIPTION OF THE DRAWINGS

In the accompanying drawings are illustrated several embodiments of the invention described herein as applied to aluminum reduction cells. In the drawings.

DETAILED DESCRIPTION OF THE INVENTION

The cathode assembly described herein is applicable to electrolytic cells used for the electrolytic production of metal from a molten compound of the metal, e.g., a salt or oxide, or a compound of the metal dissolved in a molten solvent. The principal commercial electrolytic cell to which the present invention is applicable is the Hall-Heroult (Hall) cell for the manufacture of aluminum by the electrolysis of alumina. Other metals produced by electrolysis in a fused electrolyte bath include magnesium, sodium, lithium, beryllium, boron, cerium, columbium (niobium), molybdenum, zirconium, tantalum, titanium, thorium and uranium. See, Electrochemical Engineering, by C. L. Mantell, McGraw Hill Book Company, Inc., New York, 4th Ed. 1960, pp. 398–427.

Figure 1:
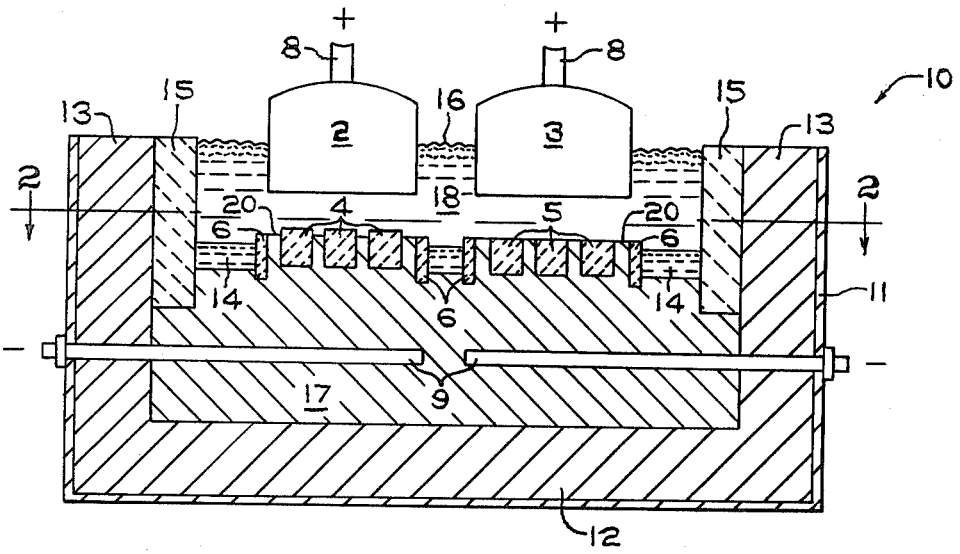
FIG. 1 is a horizontal view, partly in section, of a portion of an electrolytic cell for the production of aluminum containing cylindrical refractory hard metal cathodic elements. The cell is shown as it appears during cell operation with the pad of molten aluminum and molten electrolyte.

Referring now to FIG. 1, there is shown a horizontal view, partly in section, of a portion of an electrolytic cell 10 for the production of aluminum containing cylindrical RHM cathodic elements 4 and 5 set into pedestals 20 of the cell. The electrolytic cell comprises an outer metal shell 11, e.g., of steel, adjacent to which is disposed side walls 13 and bottom wall 12 of a refractory material such as alumina, bauxite, clay, magnesite, or aluminum silicate, which serve as an insulating lining. Optionally disposed adjacent the side walls 13 is refractory wall 15. Such wall can be prepared from a refractory metal compound, such as silicon carbide brick, that is resistant to the conditions existing within the operating electrolytic cell. Inner wall 15 of the cell can be carbon. Adjacent bottom wall 12 of the cell is Floor 17. Commonly the floor is also fabricated from a carbon material, such as anthracite, which has a negative change in resistivity with temperature to minimize the voltage drop across the floor at operating temperature. Floor 17 must be electrically conductive to carry the current passing through molten metal aluminum pad 14 to current collector bars 9.

The floor and walls of the cell generally define a chamber having an upper zone adapted to contain a body of molten electrolyte 18 having a solidified crust 16, and a lower zone adapted to receive a pool of molten aluminum 14 and the refractory hard metal (RHM) articles 4 and 5. Disposed at least partially within the chamber and partially immersed in electrolyte layer 18 are anodes 2 and 3, which are usually of carbon, suspended from hangers 8, which can be of aluminum, iron, or copper. The hangers are connected to a bus bar (not shown) to connect the anode to the positive pole of the source of electrolyzing current (not shown). As shown, the upper portion of each anode extends above the level of molten electrolyte 18 and through the crust 16 of solidified electrolyte overlying the same. As the anode is consumed during the operation of the cell it is progressively fed downwards in the well-known manner. The anodes can be of the "pre-baked" or the "self-baking" type, as is well known.

Embedded in floor 17 are current collector bars 9. Such bars serve to complete the electrical circuit by connection to a cathode bus system (not shown). Other means for withdrawing current from the cell can be employed also. However, in the arrangement shown, current passes serially from the anode bus system through anodes 2 and 3, electrolyte 18, RHM cathodic elements 4, and 5, pedestal 20 and/or molten aluminum pad 14, and carbon base 17 to collector bars 9 and thence to the cathode bus system (not shown) which is connected to the cathode (negative) pole of the source of electrolyzing current.

pedestals 20 are shown disposed beneath the shadow of anodes 2 and 3 and resting on floor 17. Although pedestals 20 are shown as having substantially the same top dimensions as the underside of the anode, they can occupy a smaller area to permit more space for the metal pad 14. The pedestal can be an integral part of floor 17, or it can be a distinct and separate piece attached, e.g., cemented, to the cell floor. Preferably, the pedestal is a separate block of the desired shape and size that is inserted and affixed, e.g., cemented, into a cavity of the same shape and size as the pedestal in the floor 17. The pedestal and floor will commonly be of the same material, e.g., carbon, in order to allow a uniform flow of electric current through the pedestal and floor to the current collector bars. Carbon materials that can be used for the pedestal (and the cell floor) are graphite, e.g., graphitized petroleum coke, porous graphite, anthracite, petroleum coke, lamp black, porous carbon and graphitized lamp black.

Figure 2:
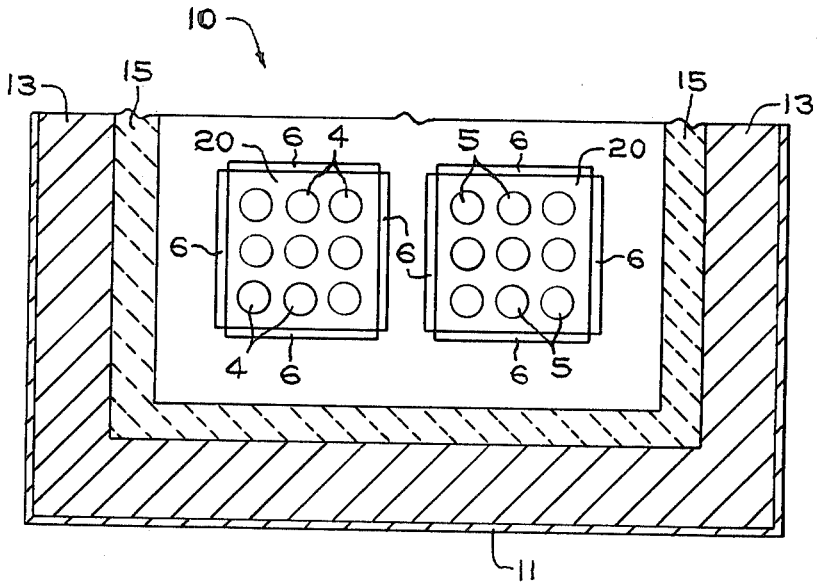
FIG. 2 is a partial plan view of FIG. 1 taken on line 2—2 of FIG. 1.

Pedestals 20, as shown in FIGS. 1 and 2, are relatively flat blocks reflecting the size dimension of the operating face of anodes 2 and 3. Although shown as being flat, the top and side surfaces of the pedestal can be grooved or of a shape other than flat, e.g., inclined, to assist in drainage of the molten aluminum produced at the cathode surface to the aluminum pad, and to assist in removing gas evolved at the cathode-anode interface to other portions of the chamber. The pedestals rise from the floor of the cell to a height of at least the interface between the lower zone of the chamber, which contains the molten metal aluminum pad 14, and the upper zone of the chamber which contains the molten electrolyte 18. As shown in FIG. 1, the pedestal extends from the floor to beyond the interface and into the upper zone of the chamber. The pedestal is below and spaced from the underside or operating face of the anode.

The interface between the upper zone of the chamber and the lower zone of the chamber will vary during cell operation as the molten aluminum is tapped from the cell. As used in the present description and claims, the interface between the upper and lower zones of the chamber intended as the minimum height of the pedestal is the maximum height, that is, i.e., the highest interface, of the molten metal pad during operation of the electrolytic cell.

Embedded in the pedestals are refractory hard metal elements 4 and 5. As shown in FIGS. 1 and 2, nine of such elements are embedded in each of the pedestals. In pedestal 20 beneath anode 2, refractory hard metal elements 4 are shown extending above the top surface of the pedestal into the molten electrolyte 18. The refractory hard metal elements embedded in the pedestal below anode 3 are shown totally embedded in the pedestal and flush with the top surface thereof.

The shape of the RHM element is not critical to the practice of the present invention. It can be in the form of bricks, studs, cylinders (hollow or solid), plates of various geometric shapes, e.g., square, rectangles, etc., as described in U.S. Pat. No. 4,071,420. As shown, the RHM elements are cylindrical in shape. When the cylinders are hollow, one or both ends of the cylinder can be sealed or closed; moreover, both ends can be open. When the top end of the cylinder is open, molten aluminum can accumulate within the cylinder and act as a molten metal cathode.

The RHM elements are embedded in the pedestals to a depth of at least about 75 percent, e.g., 80 or 90 percent, of their length. It is contemplated, as shown in FIG. 1, that the RHM elements to be totally embedded within the pedestal, i.e., below or flush with the top surface thereof. By embedding the RHM elements to at least 75 percent of their length within the pedestal, the RHM elements are protected during the start-up and initial operation of the electrolytic cell which from the evidence at hand, appears to be particularly critical periods for the RHM elements.

It is also contemplated that the sides and/or top of the pedestals, i.e., those exposed to the molten metal pad and the molten electrolyte be lined with a refractory hard metal surface. As shown in FIGS. 1 and 2, RHM plates 6 are disposed around the sides of the pedestals. The plates 6 are shown embedded in the cell floor for added support. In order to insure good electrical contact and integrity of the assembly, graphite powder, graphite cement, graphite sheet or other conductive material can be used at the point of attachement of the pedestal to the floor, of the RHM elements to the pedestal and the RHM surface to the sides or top of the pedestal.

The RHM elements are commonly placed within bores drilled in the pedestal. However, any means of embedding the RHM element in the pedestal can be used. For example, if the element is a hollow cylinder, the pedestal can core drilled so that the interior of the cylinder is filled by the pedestal material. The bores can be totally within the pedestal or can extend into the floor of the cell, i.e., to below the level of the cell floor, so that the RHM element rests in a cavity situated below the top surface of the floor. Consequently, if the pedestal should be worn away during cell operation, the RHM elements would be still supported by the sides of the bore below the level of the cell floor. The RHM elements should also be affixed, e.g., cemented, at their bottom to the pedestal or floor on which they rest so that they will remain in place during operation of the cell.

The term "refractory hard metals" has been used to specify a group of high melting hard substances which have metallic character, although, on the basis of chemical compositon, they would be considered inorganic compounds. Typical representatives of those materials are the carbides, borides, and nitrides of the transition metals in Groups 4*b*, 5*b* and 6*b* of the Periodic Table Of The Elements and the carbides and nitrides of boron, aluminum, and silicon. This designation of the Groups of the Periodic Table is based on the Periodic Table Of The Elements on the back cover of the Handbok of Chemistry and Physics, 45th Edition, The Chemical Rubber Publishing Company, 1964. A basic text describing the aforesaid refractory hard metals is *Refractory Hard Metals,* by Dr. Paul Schwarzkopf and Dr. Richard Kiefer, the MacMillan Company, New York, 1953.

As used herein, the term "refractory hard metal" or "RHM" is intended to mean and include materials comprising the carbides, borides or nitrides of the aforesaid metals, mixtures of such carbides, borides and/or nitrides, and such transition metal carbides, borides or nitrides or such mixtures containing additionally minor amounts of other metals, e.g., aluminum and boron, metal carbides, metal borides, and/or metal nitrides, metal oxides, or carbon, which materials are resistant to the chemical and physical environment of the portion of the electrolytic cell in which they are used. Of particular interest for use in the electrolytic production of aluminum are the carbides, borides and nitrides of titanium and zirconium, especially the borides of titanium and zirconium, e.g., titanium diboride and zirconium diboride, and mixtures of titanium an/or zirconium diboride with other metal carbides, nitrides, oxides, free metals, borides, and carbon. See, for example, German patent publication OLS No. 25 23 423.

Exemplary refractory hard metals include: the borides, carbides and nitrides of titanium, zirconium, hafnium, vanadium, niobium, tantalum, chromium, molybdenum, and tungsten, and the carbides and nitrides of silicon, aluminum and boron. Compositions described in the U.S. patent literature that can be used as RHM articles include: titanium dibroide, titanium diboride-titanium carbide, titanium diboride-chromium diboride, titanium diboride-aluminum nitride, titanium diboride-aluminum nitride-boron nitride, titanium diboride-aluminum nitride-aluminum, titanium diboride-boron nitride-titanium nitride, titanium diboride-boron nitride, titanium diboride-titanium nitride, titanium diboride-boron, zirconium diboride-boron, zirconium diboride-cobalt boride, zirconium diboride-cobalt boride-boron, zirconium diboride-carbon-boron, zirconium diboride-titanium diboride, zirconium diboride-silicon carbide, zirconium diboride-silicon carbide-carbon, titanium diboride-titanium carbide-aluminum, and titanium diboride-chromium oxide-aluminum oxide. In the above compositions, titanium diboride, zirconium diboride and hafnium diboride can be interchanged where they are not used simultaneously.

The refractory hard metal articles referred to above preferably possess a relatively low electrical resistivity, a low solubility in the molten metal being produced and in the molten electrolyte under cell operating conditions, is wettable by the molten metal, e.g., aluminum, and has good stability under conditions existing at the cathode of a reduction cell. As indicated, the preferred refractory hard metal materials, or at least that portion of the RHM article in contact with the molten metal, e.g., aluminum, and molten electrolyte, e.g., cryolite, are the borides of titanium, zirconium and hafnium, e.g., Group 4*b*. Particularly useful are the borides of titanium. Examples of RHM articles which are suitable for the practice of the methods of the present invention are described in U.S. Pat. Nos. 3,011,982 and 3,011,983, and German Patent Offenlegungsschrift No. 25 23 423.

In the latter publication, there is described a method for the manufacture of Group 4i metal borides by vapor phase reaction of the corresponding metal chloride, e.g., titanium tetrachloride, and boron trichloride utilizing a hydrogen plasma as a heat source. The Group 4*b* metal boride powder thereby produced is submicron in size, e.g., has a surface area of between about 3 and 35 square meters/gram and can be consolidated into shapes by hot pressing and by cold pressing and sintering.

Figure 4:
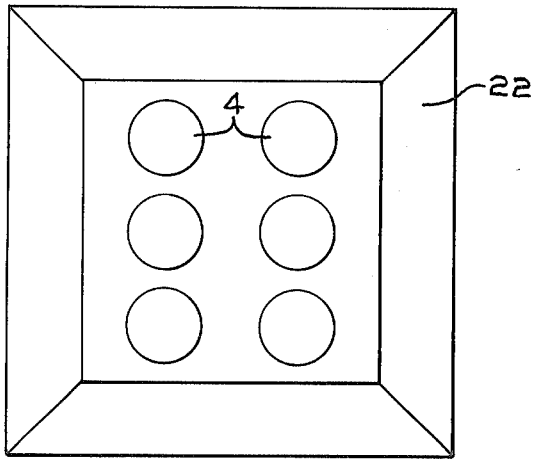
FIG. 4 is a planview of FIG. 3.
Figure 3:
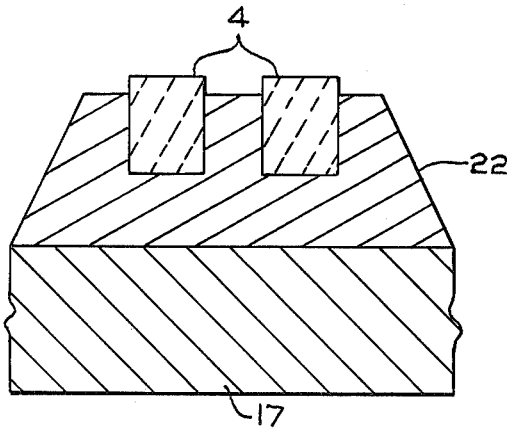
FIG. 3 is a horizontal view, partly in section, of an embodiment of the invention wherein the pedestal is shaped in the form of truncated pyramid.

Referring now to FIGS. 3 and 4, wherein like numbers indicate like parts, there is shown a horizontal and plan view, partly in section, of a pedestal 22 disposed on floor 17. The pedestal is in the form of a truncated pyramid in which are disposed cylindrical refractory hard metal elements 4. The sloped sides of pedestal 22 enhance the flow of molten aluminum from the top of elements 4 to the molten metal pad at the base of the pedestal. The sloping sides of the pedestal can be covered with a refractory hard metal surface, e.g., a plate, as described in connection with FIGS. 1 and 2.

Figure 5:
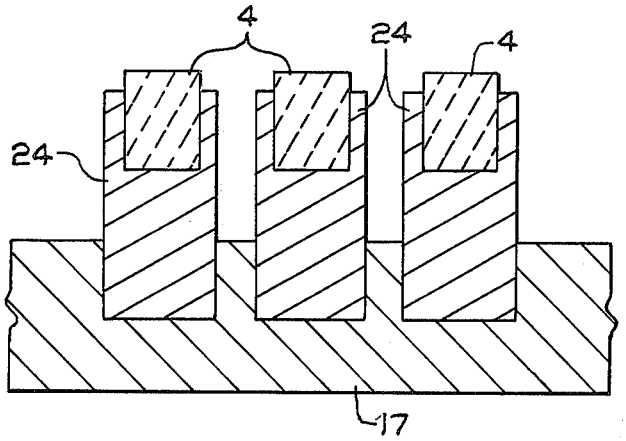
FIG. 5 is a horizontal view, partly in section, of an embodiment of the invention wherein each of the refractory hard metal cathodic elements is embedded in separate pedestals.

Referring now to FIG. 5, wherein like numbers indicate like parts, there is shown a horizontal view, partly in seciton, of an embodiment of the invention wherein individual pedestals 24 containing refractory hard metal elements 4 are embedded in floor 17 of the cell. The pedestals 24 are disposed within the shadow of the anode. The sides of each of the pedestals can be lined with a refractory hard metal surface, as described in connection with FIGS. 1 and 2.

In carrying out the present invention, an electrolytic cell, such as cell 10 in FIG. 1, is equipped with a cathode assemblies comprising a carbon pedestal disposed beneath the shadow of each of the anodes of the cell. The pedestals are each constructed to extend from the cell floor to within the upper zone of the chamber of the cell, i.e., the zone in which molten electrolyte is present during cell operation. Each of the carbon pedestals is bored to contain from about 6 to about 12 holes in which are disposed cylindrical titanium diboride cylinders. The holes in the pedestals are such that no more than about one inch of the titanium diboride cylinder protrudes from the top of the pedestal. The cell is heated and the cell chamber charged with aluminum and electrolyte or electrolyte alone. When the appropriate level of molten electrolyte is obtained, the anodes are lowered to the desired distance form the protruding titanium diboride cylinders and electrolysis begun by establishing a flow of electrolyzing current to the anodes.

The electrolyte used is a molten compound of the metal being produced or a compound of the metal dissolved in a molten solvent. In the case of the electrolytic production of aluminum, a conventional electrolyte containing cryolite, alumina and additives can be employed. Cryolite, in the form of a double salt, is represented by the formula: $Na_3AlF_6$. Typically, the electrolyte contains about eight percent alumina initially and about four to nine percent calcium fluoride. Other additives include lithium fluoride and aluminum fluoride.

Although the present process has been described with reference to specific details of certain embodiments thereof, it is not intended that such details should be regarded as limitations upon the scope of the invention except as and to the extent that they are included in the accompanying claims.

I claim:

1. In an electrolytic cell for the production of metal by electrolysis of molten electrolyte containing a compound of the metal comprising an outer shell, side and bottom walls, a floor supported by said bottom wall, said side walls and floor defining a chamber, said chamber containing a lower zone adapted to contain a molten pad of said metal and an upper zone adapted to contain a body of said molten electrolyte, and at least one anode disposed at least partially within the upper zone of said chamber, the improvement which comprises cathode assembly comprising a pedestal of an electroconductive material disposed beneath the shadow of the anode and extending for the cell floor to at least the interface between the upper and lower zones of said chamber but below and spaced from the underside of said anode, said pedestal having embedded therein and in the face thereof opposite the anode at least one refractory hard metal element, said element being embedded in said pedestal to a depth of at least about 75 percent of its length.

2. The electrolytic cell of claim 1 wherein the refractory hard metal is titanium diboride.

3. The electrolytic cell of claim 1 wherein the pedestal is carbon.

4. The electrolytic cell of claim 3 wherein the pedestal extends into the upper zone of said chamber.

5. The electrolytic cell of claim 1 wherein the refractory hard metal element is a hollow body or a solid rod.

6. The electrolytic cell of claim 1 wherein the sides of the pedestal have a refractory hard metal surface.

7. The electrolytic cell of claim 1 wherein the pedestal is in the form of a truncated pyramid.

8. The electrolytic cell of claim 7 wherein the sides of the pedestal have a refractory hard metal surface.

9. In an electrolytic cell for the production of aluminum by electrolysis of molten electrolyte containing alumina comprising an outer shell, side and bottom walls, a carbon floor supported by said bottom wall, said side walls and floor defining a chamber, said chamber containing a lower zone adapted to contain a molten pad of aluminum and an upper zone adapted to contain a body of said molten electrolyte and at least one carbon anode disposed at least partially within the upper zone of said chamber, the improvement which comprises a cathode assembly comprising a pedestal cf an electroconductive material disposed beneath the shadow of the anode and extending from the cell floor into the upper zone of said chamber but below and spaced from the underside of said anode, said pedestal having embedded therein and in the face thereof opposite the anode at least one refractory hard metal element, said element being embedded in said pedestal to a depth of at least about 75 percent of its length.

10. The cell of claim 9 wherein the pedestal is carbon.

11. The cell of claim 10 wherein the refractory hard metal element protrudes out of the pedestal in which it is embedded.

12. The cell of claims 9, 10 or 11 wherein the refractory hard metal is titanum diboride.

13. The cell of claim 12 wherein the refractory hard metal element is a hollow body or a solid rod.

14. The cell of claim 12 wherein the refractory hard metal element is a hollow cylinder sealed at the end closest to the cell floor and open at its end closest to the anode.

* * * * *

UNITED STATES PATENT AND TRADEMARK OFFICE

CERTIFICATE OF CORRECTION

PATENT NO. : 4,224,128

DATED : September 23, 1980

INVENTOR(S) : Richard J. Walton

It is certified that error appears in the above–identified patent and that said Letters Patent are hereby corrected as shown below:

Column 7, line 27, --a-- should be inserted following "comprises".

Column 7, line 30, "for" should be --from--.

Signed and Sealed this

*Seventh* Day of *April 1981*

[SEAL]

*Attest:*

RENE D. TEGTMEYER

*Attesting Officer*

*Acting Commissioner of Patents and Trademarks*